US008047184B2

(12) United States Patent
Styles et al.

(10) Patent No.: US 8,047,184 B2
(45) Date of Patent: Nov. 1, 2011

(54) EGR COOLER BYPASS STRATEGY

(75) Inventors: Daniel Joseph Styles, Canton, MI (US); Kevin Chen, Canton, MI (US); David Curtis Ives, Ann Arbor, MI (US); Frank M Korpics, Belleville, MI (US); Norman Hiam Opolsky, West Bloomfield, MI (US); Timothy Webb, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 224 days.

(21) Appl. No.: 12/533,336

(22) Filed: Jul. 31, 2009

(65) Prior Publication Data

US 2011/0023839 A1 Feb. 3, 2011

(51) Int. Cl.
*F02B 47/08* (2006.01)
*F02B 47/00* (2006.01)

(52) U.S. Cl. ..... 123/568.12

(58) Field of Classification Search ..... 123/568.12, 123/568.21, 568.11; 701/108; 60/605.2, 60/605.1, 278, 295
See application file for complete search history.

(56) References Cited

U.S. PATENT DOCUMENTS

| | | | | |
|---|---|---|---|---|
| 6,301,887 | B1 | 10/2001 | Gorel et al. | |
| 6,971,377 | B2 | 12/2005 | Moyer et al. | |
| 7,284,544 | B2 | 10/2007 | Hatano | |
| 7,363,919 | B1 | 4/2008 | Styles | |
| 7,380,544 | B2 | 6/2008 | Raduenz et al. | |
| 7,448,368 | B2 | 11/2008 | Freese | |
| 7,461,641 | B1 | 12/2008 | Styles et al. | |
| 2005/0092286 | A1 * | 5/2005 | Sasaki et al. | 123/295 |
| 2006/0112679 | A1 * | 6/2006 | Kojima et al. | 60/278 |
| 2007/0012034 | A1 * | 1/2007 | Yahata et al. | 60/295 |
| 2007/0056266 | A1 * | 3/2007 | Kurtz | 60/279 |

FOREIGN PATENT DOCUMENTS

| | | | |
|---|---|---|---|
| EP | 1640599 | A1 | 3/2006 |
| EP | 1640599 | B1 | 2/2007 |

* cited by examiner

*Primary Examiner* — Mahmoud Gimie
(74) *Attorney, Agent, or Firm* — Julia Voutyras; Brooks Kushman P.C.

(57) ABSTRACT

A system and method for controlling an engine control an EGR cooler bypass valve to divert at least a portion of EGR flow around an EGR cooler when operating under cooler fouling/plugging conditions, such as during idle, off-idle, exhaust system warm up and DPF regeneration or other post injection operation with EGR gas temperature below a corresponding threshold or with EGR low-temperature coolant temperature below a corresponding threshold. The system and method reduce exhaust gases passing through the EGR cooler that contain a high concentration of unburned or partially unburned fuel when the temperature in the EGR system is lower than the fuel condensation temperature.

20 Claims, 3 Drawing Sheets

EGR COOLER BYPASS STRATEGY

BACKGROUND

1. Technical Field

The present disclosure relates to exhaust gas recirculation (EGR) systems having EGR coolers and preventing fouling of the EGR cooler by bypassing flow around the EGR cooler.

2. Background Art

One known approach to reduce the amount of NOx produced during combustion in an internal combustion engine is to mix in exhaust gases with the fresh air, commonly called exhaust gas recirculation (EGR). In diesel engines, very high levels of EGR can be tolerated. NOx is further reduced when EGR gases are cooled in the EGR loop, as NOx formation is highly sensitive to temperature. EGR cooling also reduces boost required as the EGR gases are more dense. Thus, an EGR cooler (or heat exchanger) is commonly disposed in the EGR duct.

Deposits form on the interior surfaces of the EGR cooler, first causing the EGR cooler to be less efficient and finally leading to plugging of the EGR cooler. To address that problem, EGR catalysts/filters have been provided in the EGR duct upstream of the EGR cooler. In some prior art systems, a catalyst is employed to oxidize unburned fuel and some particulate matter in the exhaust gases. In other prior art systems, a particulate filter is employed to remove the particulate matter from the exhaust gases. The requirement of a catalyst and/or filter in the EGR duct presents an additional cost and additional system complexity. In addition, EGR catalysts/filters provide a flow restriction that may adversely impact the available EGR flow rate.

Prior art engine control strategies may also control an EGR cooler bypass valve to partially or completely redirect EGR flow around the EGR cooler when exhaust gas temperature is below a threshold to reduce or eliminate formation of water condensation or to maintain charge temperatures in the intake manifold to a desired level at low speeds and loads. However, the prior art fails to recognize other conditions that contribute to accelerated fouling or plugging of an EGR cooler, particularly those associated with fuel condensation.

SUMMARY

It has been found that certain engine operating conditions are predominantly responsible for fouling the EGR cooler. Thus, according to an embodiment of the disclosure, a bypass to the EGR cooler is provided and the EGR gases are partially or completely directed through the bypass when the engine conditions leading to EGR cooler fouling are encountered.

An advantage according to the disclosure is that the EGR cooler performance can be maintained without providing an oxidation catalyst and/or a diesel particulate filter in the EGR duct.

The engine conditions leading to rapid deposit buildup in the EGR cooler are: idle, off-idle, exhaust system warm up, DPF regeneration, and other engine operating conditions when a post-injection is used and the EGR temperature is less than a temperature threshold. The present disclosure recognizes that these conditions are generally associated with temperature of the EGR gases being below a fuel condensation threshold and a higher concentration of unoxidized or partially oxidized fuel in the EGR gases. It has been found that the unburned fuel forms a coating on the EGR cooler surfaces. During subsequent operation, the coating attracts soot. Successive repetitions of these processes builds layer upon layer. The buildup is prevented by avoiding the high level of unburned fuel from entering the EGR cooler when the EGR gas temperature is lower than the fuel condensation temperature.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to configurations for aftertreatment and EGR systems for a turbocharged, diesel engine. Those of ordinary skill in the art may recognize similar applications or implementations consistent with the present disclosure, e.g., ones in which components are arranged in a slightly different order than shown in the embodiments in the Figures. Those of ordinary skill in the art will recognize that the teachings of the present disclosure may be applied to other applications or implementations.

Figure 1:
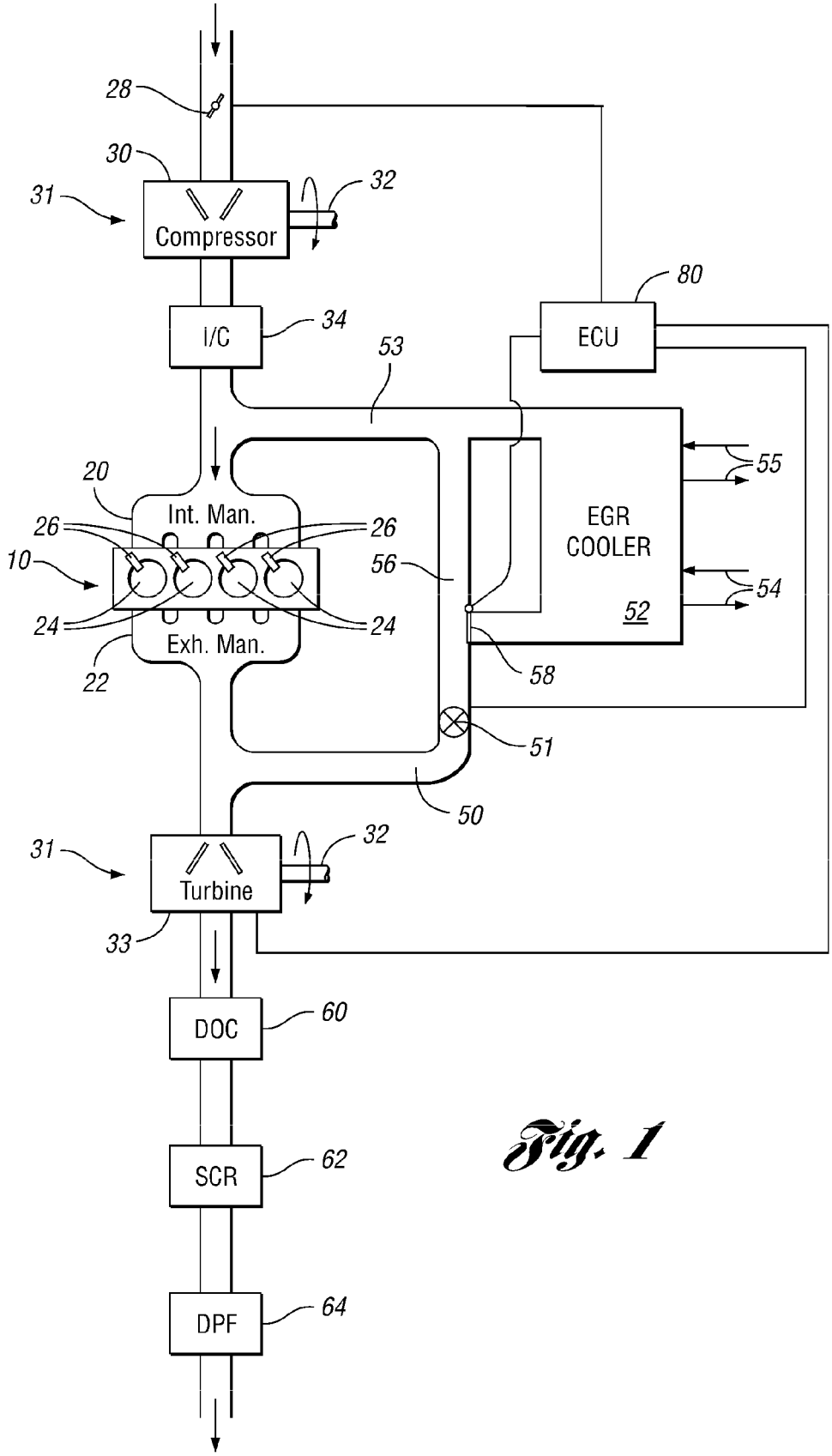
FIG. 1 is a schematic of an internal combustion engine including an intake system, an exhaust system, and an EGR system according to one embodiment of the present disclosure.

In FIG. 1, an internal combustion engine 10 is shown which has an intake manifold 20 and an exhaust manifold 22. Engine cylinders 24 have a fuel injector 26 spraying fuel directly into engine cylinders 24. A throttle valve 28 is provided in the engine intake upstream of a compressor 30 of turbocharger 31, which has a shaft 32 also coupled to turbine 33 in the engine exhaust. Compressor 30, turbine 33, and shaft 32 are typically housed together, but shown separated here for the convenience of the illustration. The work extracted from turbine 33 is transmitted via shaft 32 to drive compressor 30.

At the exhaust side of engine 10, exhaust gases are extracted in an EGR system. An EGR duct 50 conducts exhaust gases to EGR valve 51. The exhaust gases are provided to EGR cooler 52 and then through another portion of EGR duct 53 to the engine intake. The amount of flow is controlled by EGR valve 51. EGR cooler 52 has a high temperature coolant loop 54 in which a fluid, e.g., engine coolant, is circulated through a path in EGR cooler 52. In some embodiments, a low temperature coolant loop 55 is also provided to EGR cooler 52. Also provided is an EGR bypass duct 56, which may be positioned externally relative to cooler 52 as illustrated, or integrated within the cooler housing to bypass the cooler core. EGR bypass valve 58 is placed at the junction of EGR bypass duct 56 and EGR cooler 52. In FIG. 1, EGR bypass valve 58 is shown as a flapper valve closing off flow to EGR cooler 52. Alternatively EGR bypass valve 58 may be implemented by a proportionally controlled valve to redirect control the relative proportion or amount of exhaust gases directed through bypass duct 56 and EGR cooler 52. In either implementation, EGR bypass valve 58 can be rotated to close off flow through EGR bypass duct 56. In an alternative, an EGR bypass valve is disposed in EGR bypass duct 56. When it is open, flow preferentially flows through EGR bypass duct 56 because EGR cooler 52 has a higher pressure drop. In yet another alternative, an EGR bypass valve is located near an exit of EGR cooler 52, the valve either closing off the exit of EGR cooler 52 or closing off EGR bypass duct 56. In some alternative embodiments, only one heat exchange fluid is provided to EGR cooler 52. In another alternative embodiment, the EGR bypass passage can be completely removed from the EGR cooler and contain a separate EGR metering valve similar to 51. In FIG. 1, an in-line, four-cylinder engine is illustrated. However, the disclosure is directed also to engines with: multiple banks in a vee configuration, various numbers of cylinders, multiple turbochargers, etc.

The exhaust aftertreatment components are generally placed downstream of turbine 33. These may include a diesel oxidation catalyst (DOC) 60, selective reduction catalyst (SCR) 62, and diesel particulate filter (DPF) 64. The order of the exhaust aftertreatment components shown in FIG. 1 is shown as one example, and not intended to be limiting.

Performance of EGR cooler 52 depends on the surfaces remaining relatively free of deposits. If deposits foul internal surfaces, the efficiency of the heat exchanger is compromised. If deposit formation continues unchecked, EGR cooler 52 becomes plugged.

As recognized by the present disclosure, certain operating conditions contribute disproportionately to EGR cooler 52 fouling and/or plugging. Reducing or eliminating flow through EGR cooler 52 under these operating conditions should reduce fouling and/or plugging to extend the life and maintain efficient operation of EGR cooler 52. The present disclosure recognizes that this could be accomplished by closing EGR valve 51. However, this may negatively impact NOx feedgas emissions. According to an embodiment of the present disclosure, EGR bypass valve 58 is commanded to a position to redirect at least a portion of EGR around EGR cooler 52 to flow through bypass duct 56 to the engine intake during conditions which would lead to fouling or plugging of EGR cooler 52. As such, the portion of EGR traveling through bypass duct 56 is not cooled due to bypassing cooler 52. When operating conditions of engine 10 change from such fouling/plugging conditions, EGR bypass valve 58 is commanded to reduce, or eliminate, flow to EGR bypass duct 56, thereby allowing more flow, or all flow, through EGR cooler 52.

As generally understood by those of ordinary skill in the art, DPF 64 operates in a collection mode in which particulate matter (soot) is filtered from exhaust gases. After a certain quantity of particulate matter is collected, DPF 64 is regenerated by raising the temperature of exhaust gas into DPF 64 above the ignition temperature of the particulate matter. Regeneration may be initiated by injectors 26 post-injecting fuel into cylinders 24 to provide an unburned fuel/exhaust mixture to DOC 60 to be oxidized to raise exhaust temperature to DPF 64.

Figure 2:
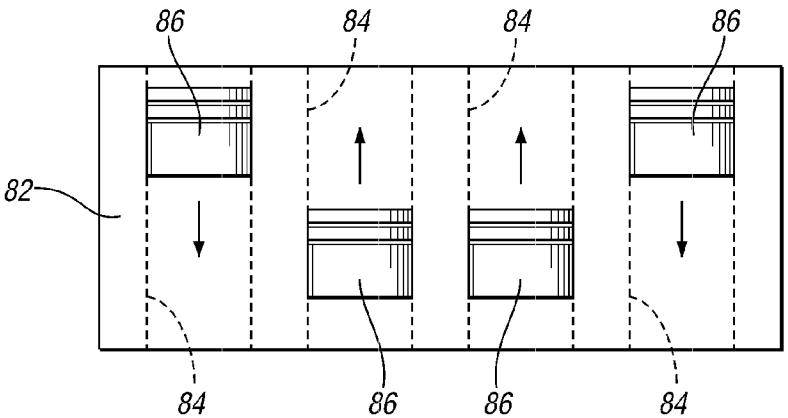
FIG. 2 is a side view of an engine showing pistons in engine cylinders.

In FIG. 2, an engine block 82 is shown with four cylinders 84 formed within. Pistons 86 reciprocate within cylinder 84. The injection timings, as will be discussed in regards to FIG. 3, are described in terms of crank angle degrees in a conventional manner that relates the position of the piston in a particular cylinder when fuel is injected into that particular cylinder.

Figure 3:
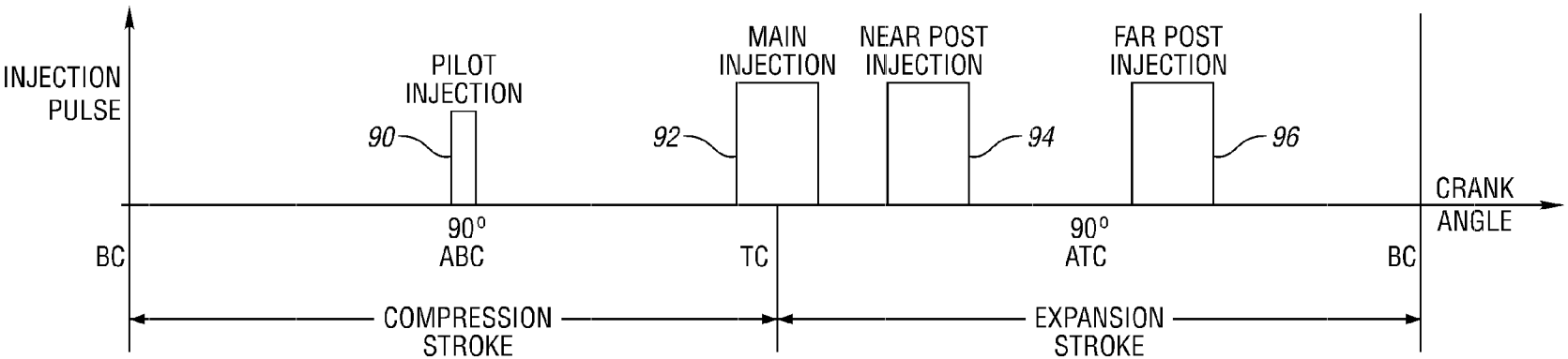
FIG. 3 is a time line of fuel injection events.

Sample injection timings are shown in FIG. 3. One or more post injections may be provided in addition to pilot injection 90 and main injection 92. Typically, both a near post injection 94 and a far post injection 96 are provided to initiate and sustain regeneration of DPF 64. Near post injection 94 commences, i.e., start of injection as early as 20 degrees after top center (ATC), but more typically at 30 degrees ATC. Far post injection 96 commences typically after 90 degrees ATC. Fuel injected during far post injection 96 is mostly unoxidized and enters the exhaust system unburned. The fuel is oxidized in the DOC to raise the exhaust temperature to the level needed to oxidize the carbonaceous particulate matter.

Fuel, or partially oxidized fuel, supplied to the exhaust system during post injection may condense in EGR cooler 52 when temperature in the EGR system is below a temperature threshold. In one embodiment, when the exhaust gas temperature at EGR valve 51 is above an inlet temperature threshold, e.g., determined at EGR valve 51, and the exhaust gas temperature at the outlet of the EGR cooler is above an outlet temperature threshold, then the fuel does not condense. EGR temperature upstream of EGR cooler 52 can be estimated for a different location than at EGR valve 51. Temperature at any place upstream of EGR cooler 52 can alternatively be used.

Even with post-injection and EGR flowing through EGR cooler 52, deposits do not form in EGR cooler 52. However, under the condition of post injection and a temperature at EGR valve 51 lower than the inlet temperature threshold and a temperature at the outlet of EGR cooler 52 lower than the outlet temperature threshold, EGR cooler 52 can become fouled. In such a situation, bypass valve 58 is commanded to a bypass position, in which at least a portion of the gases are short-circuited around EGR cooler 52, so that EGR gases containing post-injected fuel do not enter EGR cooler 52. As used herein, a post injection refers to a fuel injection that occurs after the main injection, which is initiated near top center between the compression and expansion stroke.

The present disclosure also recognizes that EGR cooler 52 may also foul or plug at engine idle, off-idle, DPF regeneration, and exhaust system warm up operating conditions in which there is a higher concentration of unburned fuel and exhaust temperatures are low. Engine idle and off-idle are conditions with very low brake mean effective pressure (BMEP) and engine speed near the minimum. BMEP, an engine parameter known to those skilled in the art, is proportional to engine torque, but normalized by engine displacement. Off-idle conditions are those with a speed less than 1200 and a BMEP about 1.0 bar higher than engine idle (BMEP of about 1.2 bar). Exhaust system warm up follows a cold start of the engine. Post injected fuel oxidizes in a diesel oxidation catalyst to cause an exotherm in the exhaust aftertreatment system. EGR bypass valve 58 is commanded to limit or curtail flow through EGR cooler 52 in response to idle conditions and during exhaust system warm up when the temperature in the EGR system is less than threshold temperatures. The following table illustrates that the threshold temperatures can be selected for each operating regime. It is recognized that in DPF regeneration operating mode, the amount of post injected fuel is substantial, which may lead to higher hydrocarbon concentration in the EGR stream. Also, the hydrocarbon species distribution is impacted by the timing of the post injection. The concentration of hydrocarbons in the EGR gases and the species distribution impacts the amount of fuel condensation in EGR cooler 52. Thus, the temperature threshold at which bypassing is commanded depends on the operating condition. The table below is simply one example of how to set thresholds and provided for illustrative purposes only and not intended to be limiting. For example, in the table below, the conditions at which a test is conducted to determine whether EGR cooler 52 should be bypassed are: idle and off-idle; exhaust system warm up; and DPF regeneration with both near and far post injections.

| Operating condition potentially leading to fouling | EGR gas inlet temperature threshold (at EGR valve) | EGR gas outlet temperature threshold (at EGR cooler outlet) | EGR low-temperature coolant outlet threshold |
|---|---|---|---|
| Idle and off-idle | 175 degrees C. | 75 degrees C. | 50 degrees C. |
| Exhaust system warm up (near post injection) | 200 degrees C. | 80 degrees C. | 55 degrees C. |
| DPF regeneration (near post injection) | 200 degrees C. | 80 degrees C. | 55 degrees C. |
| DPF regeneration (far post injection) | 220 degrees C. | 100 degrees C. | 65 degrees C. |

In the table above, there are three threshold temperatures listed. Column 2 shows the EGR gas inlet temperature threshold. This is measured or estimated EGR gas temperature in the EGR duct upstream of EGR cooler 52. This can be determined at EGR valve 51 or elsewhere. Another temperature threshold is the EGR gas outlet temperature threshold, which is a determination of the EGR gas temperature exiting the outlet of EGR cooler 52. Another temperature threshold is the EGR low-temperature coolant outlet threshold. In one embodiment, EGR cooler 52 is provided with a loop for high-temperature coolant and a loop for low-temperature coolant. The low-temperature coolant correlates well with EGR gas outlet temperature. Thus, this threshold (EGR low-temperature coolant outlet) can be used in place of, or in addition to, EGR gas outlet temperature threshold. As described above, the EGR low-temperature coolant outlet threshold is estimated at the low-temperature coolant outlet, but may alternatively be determined at the inlet, since the temperature of the low-temperature coolant does not change substantially in the cooler due its high thermal capacity.

The threshold temperatures in the table above are example temperatures. Actual threshold temperatures may vary from these values depending on the particular application, engine/EGR cooler layout, etc.

Also the threshold temperatures in the table are for a scenario in which the unburned hydrocarbon level is about 1000 ppm (based on C1 hydrocarbons). If the level of hydrocarbons is significantly less than the 1000 ppm, the temperature thresholds can be lowered from the temperatures in the table. The amount of hydrocarbon in the exhaust stream can be estimated by modeling, measured, or a combination of the two. Alternatively, the hydrocarbons can be determined from a lookup table. Another factor affecting the threshold temperature is the hydrocarbon species in the exhaust stream. Higher molecular weight hydrocarbons condense at higher temperatures than lower molecular weight hydrocarbons. Later injected fuel has less time to react. Thus, unburned hydrocarbons from such later injected fuel tend to be of higher molecular weight than those from an earlier injection.

Figure 4:
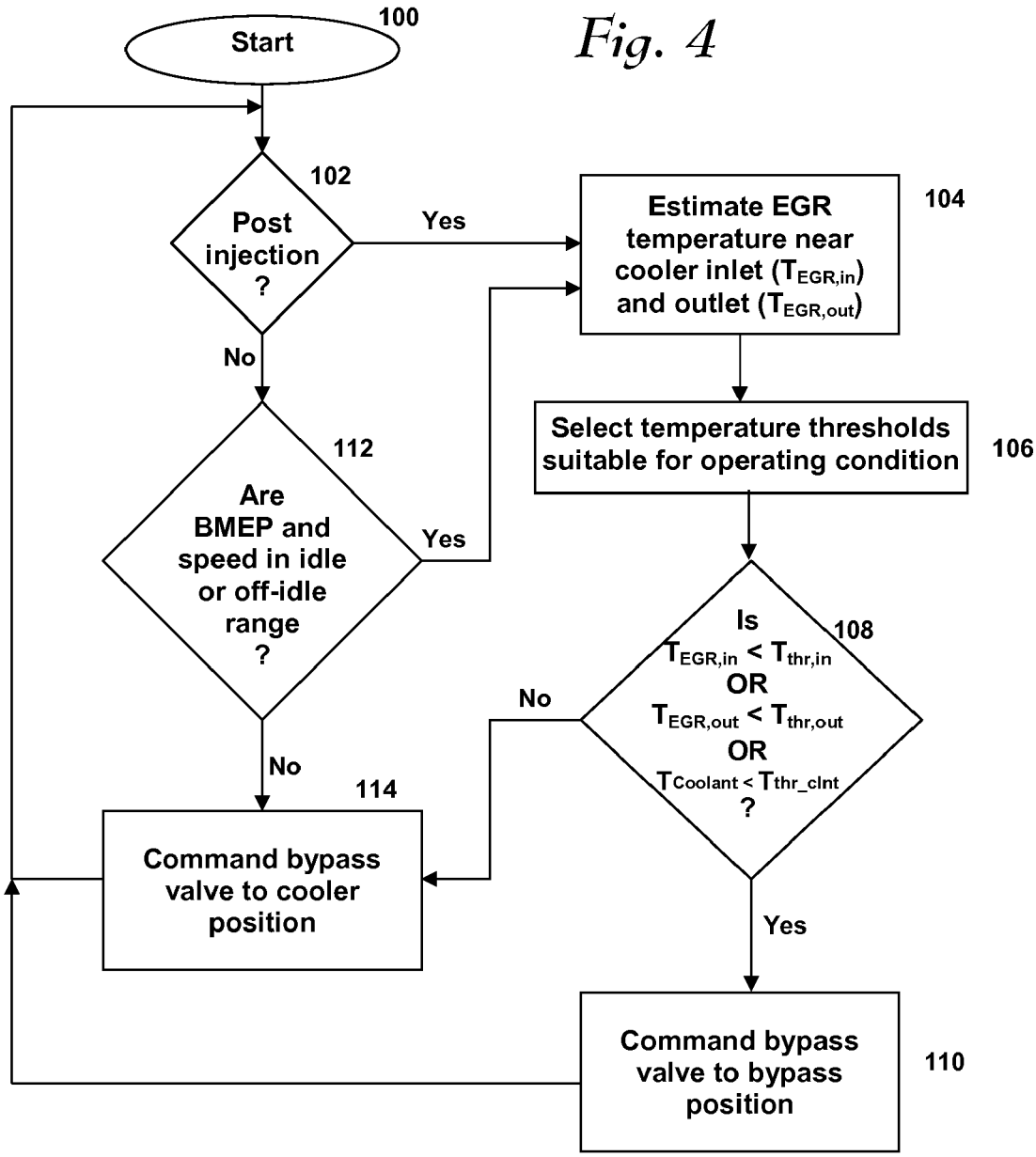
FIG. 4 is a flowchart of an EGR bypass control valve strategy according to one embodiment of the disclosure.

FIG. 4 illustrates operation of a system or method for controlling EGR flow according to embodiments of the present disclosure. As those of ordinary skill in the art will understand, various functions represented by the blocks of FIG. 4 may be performed by software and/or hardware under direct or indirect control of ECU 80 (FIG. 1). In general, instructions are stored in computer readable media within ECU 80 and executed by a microprocessor to perform the illustrated method to operate the system. Depending upon the particular processing strategy, such as event-driven, interrupt-driven, etc., the various functions may be performed in an order or sequence other than illustrated in the Figures. Similarly, one or more steps or functions may be repeatedly performed, or omitted, although not explicitly illustrated. In one embodiment, the functions illustrated are primarily implemented by software, instructions, or code stored in a computer readable storage medium and executed by a microprocessor-based computer or controller, such as represented by ECU 80, to control operation of the EGR system of an internal combustion engine according to the present disclosure.

The system or method begins with determining whether EGR gases should flow through EGR cooler 52 at 100 in FIG. 4. First it is determined in 102 whether there is post injection. If so, control passes to 104, to determine EGR gas temperature at both the inlet and the outlet to EGR cooler 52, $T_{EGR,in}$ and $T_{EGR,out}$. The temperatures are determined by measuring, modeling, or a combination. As described herein, EGR inlet temperature is determined at the EGR valve. However, the EGR inlet temperature can be determined at other locations. If either EGR temperature is determined at another location in the EGR system, then the temperature threshold at which fuel condensation is determined to cause a problem is appropriately adjusted. As discussed above, the threshold temperatures determined to cause a problem $T_{thr,in}$ and $T_{thr,out}$ may depend on operating condition. Thus, in 106, the threshold appropriate for the present operating condition is selected based on the operating condition. Continuing to refer to FIG. 4, control then passes to 108 to determine if any of EGR inlet temperature, EGR outlet temperature or coolant temperature ($T_{coolant}$) at the EGR cooler are less than their corresponding thresholds, $T_{thr,in}$, $T_{thr,in}$, and $T_{thr,clnt}$, respectively. The operation in 108 is a Boolean OR, so that if any returns a positive result, control passes to 110 in which bypass valve 58 is commanded to the bypass position. If, however, all tests in 108 return a negative result, then control passes to 114 to command bypass valve 58 to the cooler position, so that EGR flow does pass through EGR cooler 52. Three tests are shown in 108. Alternatively, any combination of comparisons (e.g., using only one or two of the tests) of the three actual temperatures to their respective threshold temperatures can be used in 106 to determine that fuel condensation in EGR cooler 52 is likely to occur and thus should be bypassed.

In 102 of FIG. 4, if there is no post injection, control passes to 112 in which it is determined whether the present operating condition is in a BMEP/speed range which indicates an idle condition or off-idle condition. If so, control passes to 104 to determine whether the inlet and outlet temperatures are cooler than those at which fuel condensation can lead to deposits. If a negative result in 114, control passes to step 114 in which bypass valve 58 is commanded to the cooler position, meaning that flow is directed through EGR cooler 52. From both 110 and 114, control passes to 102 to determine if post injection is presently occurring. The order of the determination of whether post injection is occurring 102 and whether the engine is at idle conditions 102 can be performed in a different order than shown in FIG. 4.

As such, by monitoring operating conditions and recognizing conditions leading to accelerated fouling and/or plugging of the EGR cooler, embodiments of the present disclosure selectively redirect at least a portion of EGR flow around the EGR cooler (or cooler core) under these conditions to avoid fouling/plugging. Embodiments of the present disclosure maintain EGR cooler performance without providing an oxidation catalyst and/or a diesel particulate filter in the EGR duct.

While the best mode has been described in detail, those familiar with the art will recognize various alternative designs and embodiments within the scope of the following claims. For example, the routine depicted in FIG. 4 is but one example to accomplish an embodiment of the present disclosure. Also, the present disclosure describes several engine conditions which lead to EGR cooler fouling. The bypass valve can be closed for any engine conditions leading to deposit formation in the EGR cooler, which may include additional conditions beyond those described herein. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed:

1. A method to control an internal combustion engine having an EGR system including an EGR cooler and an EGR cooler bypass valve, comprising:

commanding the EGR cooler bypass valve to a bypass position based on at least one fuel injector being commanded to provide a post injection and an EGR gas inlet temperature being below a corresponding EGR gas inlet temperature threshold.

2. The method of claim 1 wherein the EGR cooler bypass valve has two positions:

a cooler position which substantially closes off flow to an EGR bypass duct and allows flow through the EGR cooler; and the bypass position which substantially closes off flow to the EGR cooler and allows flow through the EGR bypass duct.

3. The method of claim 1, further comprising:

determining an EGR gas outlet temperature wherein the commanding of the EGR cooler bypass valve to the bypass position is further based on the EGR gas outlet temperature being below a corresponding EGR gas outlet temperature threshold.

4. The method of claim 1 wherein commanding of the EGR cooler bypass valve is further based on an EGR low-temperature coolant temperature being below a corresponding EGR low-temperature coolant threshold.

5. The method of claim 1, further comprising:

commanding the EGR cooler bypass valve to a cooler position when the EGR gas inlet temperature is greater than the corresponding EGR gas inlet temperature threshold and an EGR gas outlet temperature is greater than a corresponding EGR gas outlet temperature threshold.

6. The method of claim 5 wherein the EGR gas inlet temperature threshold and the EGR gas outlet temperature threshold are based on engine operating conditions.

7. The method of claim 1 wherein the engine has pistons reciprocating in engine cylinders and post injection is an injection commencing later than about 20 degrees into an expansion stroke of a piston.

8. A method to control an internal combustion engine having an EGR system with an EGR cooler and an EGR bypass valve disposed in an EGR cooler bypass duct, the engine also including a particulate filter, the method comprising:

commanding the EGR bypass valve to a bypass position during particulate filter regeneration wherein the bypass position redirects at least a portion of flow through the EGR bypass duct and around the EGR cooler; and wherein the commanding is further based on an EGR gas inlet temperature being below an EGR gas inlet temperature threshold and wherein the EGR gas inlet temperature is determined at a location in the EGR system upstream of the EGR cooler.

9. The method of claim 8 wherein the commanding is further based on an EGR gas outlet temperature being below an EGR outlet temperature threshold wherein the EGR gas outlet temperature is determined at a location in the EGR system downstream of the EGR cooler.

10. The method of claim 8 wherein the engine has fuel injectors coupled to engine cylinders and during particulate filter regeneration, the fuel injectors provide a post-injection, so that the commanding is based on there being a post-injection.

11. The method of claim 10 wherein the engine has pistons reciprocating in engine cylinders and the post-injection is a fuel injection commencing more than 20 degrees after top center between an compression and an expansion stroke of the piston travel.

12. The method of claim 8 wherein the commanding is further based on an EGR low-temperature coolant temperature being below an EGR low-temperature coolant threshold.

13. The method of claim 8 further comprising:

commanding the EGR bypass valve to a cooler position when the EGR gas inlet temperature is greater than the EGR gas inlet temperature threshold and an EGR gas outlet temperature is greater than a corresponding EGR gas outlet temperature threshold.

14. The method of claim 13 wherein the EGR gas inlet temperature threshold and the EGR gas outlet temperature threshold are based on engine operating conditions.

15. An internal combustion engine system, comprising:

an engine having an intake and an exhaust;

an EGR system, including:

an EGR duct coupled between the intake and the exhaust;

an EGR valve disposed in the EGR duct;

an EGR cooler disposed in the EGR duct;

an EGR bypass duct arranged in parallel with the EGR cooler wherein the EGR bypass duct is coupled to the EGR duct on an upstream end of the EGR cooler and on a downstream end of the EGR cooler; and an EGR bypass valve disposed in the EGR bypass duct at one of: the upstream coupling of the EGR bypass duct with the EGR cooler and the downstream coupling of the EGR bypass duct with the EGR cooler;

an electronic control unit electronically coupled to the engine, the EGR valve, and the EGR bypass valve wherein the EGR bypass valve has two positions: a bypass position in which the EGR bypass valve blocks substantially all flow through the EGR cooler and a cooler position in which the EGR bypass valve blocks substantially all flow through the EGR bypass duct wherein the electronic control unit commands the EGR bypass valve to the bypass position when the engine operating conditions is one of idle, off-idle, and post injection and commands the EGR bypass valve to the cooler position otherwise; and fuel injectors coupled to engine cylinders wherein the electronic control unit determines idle and off-idle based on engine BMEP being below a BMEP threshold.

16. The method of claim 15 wherein the idle and off-idle conditions are based on engine speed being below a speed threshold.

17. The system of claim 15 wherein the post-injection is an injection event which commences later than 20 degrees after top center.

18. The system of claim 15 wherein the commanding of the EGR bypass valve to the bypass position is further based on an EGR gas inlet temperature being below an EGR gas inlet temperature threshold and an EGR gas outlet temperature being below an EGR gas outlet temperature threshold.

19. The system of claim 18 wherein the EGR gas inlet temperature threshold and the EGR gas outlet temperature threshold are based on engine operating condition.

20. The system of claim 15 wherein the commanding of the EGR bypass valve to the bypass position is further based on an EGR low-temperature coolant temperature being below an EGR low-temperature coolant temperature threshold.

* * * * *